US005248314A

United States Patent [19]

Bühler

[11] Patent Number: 5,248,314

[45] Date of Patent: Sep. 28, 1993

[54] HIGH TEMPERATURE DYEING OF POLYESTER AND POLYESTER-CONTAINING TEXTILE MATERIALS WITH CYANO GROUP CONTAINING AZO DYE

[75] Inventor: Ulrich Bühler, Alzenau, Fed. Rep. of Germany

[73] Assignee: Hoechst Mitsubishi Kasei Co., Tokyo, Japan

[21] Appl. No.: 966,322

[22] Filed: Oct. 26, 1992

[30] Foreign Application Priority Data

Nov. 7, 1991 [DE] Fed. Rep. of Germany ..... 4136654

[51] Int. Cl.[5] ..... D06P 3/52; D06P 3/54; D06P 3/82; D06P 1/18

[52] U.S. Cl. ..... 8/475; 8/531; 8/532; 8/662; 8/922

[58] Field of Search ..... 8/475, 531, 532

[56] References Cited

U.S. PATENT DOCUMENTS 5,019,133 5/1991 Himeno et al. ..... 8/531

FOREIGN PATENT DOCUMENTS 324404 7/1989 European Pat. Off. .
324409 7/1989 European Pat. Off. .
499090 8/1992 European Pat. Off. .
501238 9/1992 European Pat. Off. .

*Primary Examiner*—A. Lionel Clingman
*Attorney, Agent, or Firm*—Connolly and Hutz

[57] ABSTRACT

The present invention relates to a process for the HT dyeing of polyester or polyester-containing textile materials at pH 8 to pH 11, characterised in that one or more monoazo dyes are used of the general formula I

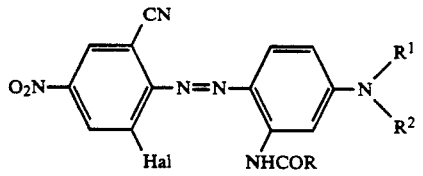

(I)

where
Hal is chlorine or bromine,
R is alkyl of 3 to 7 carbon atoms, and
$R^1$ and $R^2$ are each independently of the other linear alkyl of 2 to 5 carbon atoms or allyl.

9 Claims, No Drawings

HIGH TEMPERATURE DYEING OF POLYESTER AND POLYESTER-CONTAINING TEXTILE MATERIALS WITH CYANO GROUP CONTAINING AZO DYE

The present invention relates to a process for the HT dyeing of polyester or polyester-containing textile materials.

In general, the HT dyeing of polyester or polyester-containing textile materials with disperse dyes from an aqueous dyebath within the temperature range from 120° to 140° C. is carried out at a pH of 4 to 6, since a higher pH destroys all or some of the disperse dye; colour strength is lost and shifts in hue occur, and the dyeings are not reproducible. Also, in a separate operation prior to dyeing, the polyester fibre is normally subjected to an alkaline rinse treatment in order to remove auxiliaries used in weaving or spinning the fibre. These auxiliaries are for example oiling or sizing agents, the presence of which would make level dyeing of the polyester fibre difficult or impossible. The alkaline treatment is also carried out in order that oligomers on the polyester fibre, which have emerged from the inside of the fibre in the course of the dyeing process and make the dyeing appear unlevel, may be destroyed and kept in the aqueous dyeing liquor.

This alkaline rinse treatment is advantageously carried out at elevated temperature. To save time and energy and in order to reduce the number of machines required for the two processes, alkaline pretreatment and dyeing, it has always been an objective to combine the two processes in a single-bath rinsing and dyeing process. However, to achieve this objective it is necessary to develop processes which give reproducible dyeings in an aqueous dyebath at pH 8 to pH 11.

Polyester-cellulose and polyester-polyamide blend fabrics are in general dyed with disperse and reactive dyes respectively from an aqueous dyebath in two dyeing operations. As mentioned above, the disperse dyes are applied to the polyester portion at pH 4 to 6, while the reactive dyes are applied to the cellulose or polyamide portion at a pH between pH 11 and 13. Here too it has been a past objective to develop a single-bath application process for the two dye classes. To this end, a search has been on for reactive dyes which dye even at a pH between 8 and 11, and here too it was necessary to have processes which ensure that under these conditions the polyester portion can be reproducibly dyed with disperse dyes.

To remedy the defects of prior art processes, German Offenlegungsschrift 3,938,631 describes a method whereby disperse dyes are dyed at a pH between pH 8 and 10 in the presence of at least one, optionally nitrogen-substituted amino acid and/or at least one alkali metal salt of an optionally nitrogen-substituted amino acid.

However, even by this method it is not possible to produce bright blue dyeings within the stated pH range using the currently commercially available blue azo dyes without loss of brilliance and colour strength, without shift in hue and without distinctly higher levels of hydrolysed dye in the dyehouse effluent.

It is known in the literature that azo blues with an o-disposed cyano group in the diazo component are in general limited in pH stability to pH 7 or below (see Rev. Prog. Coloration, Vol. 17, page 72 ff (1987), Table 3).

It has now been found, surprisingly, that the problems mentioned can be remedied by using dyes of the general formula I having the indicated meanings for the substituents on the chromophore.

The invention accordingly provides a process for the HT dyeing of polyester or polyester-containing textile materials at pH 8 to pH 11, characterised in that one or more monoazo dyes are used of the general formula I

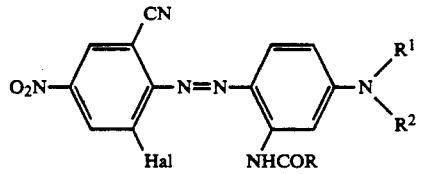

(I)

where

Hal is chlorine or bromine,

R is alkyl of 3 to 7 carbon atoms, and $R^1$ and $R^2$ are each independently of the other linear alkyl of 2 to 5 carbon atoms or allyl.

Alkyl R of 3 to 7 carbon atoms is for example n-propyl, isopropyl, n-butyl, isobutyl, sec-butyl, tert-butyl, n-pentyl, 2-pentyl, 3-pentyl, isopentyl, n-hexyl or 3-heptyl.

Linear alkyl $R^1$ or $R^2$ of 2 to 5 carbon atoms is ethyl, n-propyl, n-butyl or n-pentyl.

Preferred radicals R are n-propyl and isopropyl. Particularly preferred radicals are n-butyl, isobutyl, 2-pentyl, 3-pentyl and isopentyl. A very particularly preferred radical R is n-pentyl.

Preferred radicals $R^1$ and $R^2$ are n-propyl, n-butyl and allyl. A particularly preferred radical is ethyl.

Preferably, $R^1$ and $R^2$ are identical. Particularly preferably, $R^1$ and $R^2$ are each ethyl.

Preferably, the sum total of the carbon atoms in the radicals R, $R^1$ and $R^2$ is 8 or 10, but particularly preferably it is 9.

Preferred dyes for use in the process according to the present invention are those having preferred or particularly preferred radicals R, $R^1$ and $R^2$.

Particularly preferred dyes for use in the process according to the present invention are those where R is pentyl, in particular n-pentyl, and $R^1$ and $R^2$ are each ethyl.

A preferred process according to the present invention, furthermore, is a process using mixtures of dyes having preferred or particularly preferred radicals R, $R^1$ and $R^2$.

These mixtures are preferably three-dye mixtures, but particularly preferably two-dye mixtures.

The proportion of any one component in a two-component mixture is preferably 10 to 90% by weight, particularly preferably 30 to 70% by weight, very particularly preferably 40 to 60% by weight.

The proportion of any one component in a three-component mixture is preferably 5 to 80% by weight, particularly preferably to 40% by weight.

Dyes of the general formula I and mixtures thereof are known in part and described in EPA 324 409 and 324 404.

Dyes not described therein can be prepared in a manner known per se analogously to the statements made therein in that an amine of the general formula IV

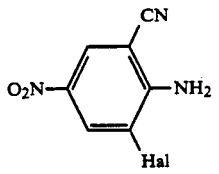

IV is diazotized and the product is coupled with a coupling component of the general formula V

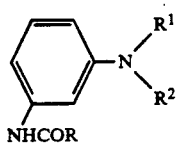

V wherein Hal, R, $R^1$ and $R^2$ are defined as indicated above.

Preferably, the process according to the present invention is carried out at pH 9 to pH 10.

The process according to the invention is preferably carried out in a dyeing autoclave.

The polyesters to be dyed by the process according to the invention are in particular those based on polyethylene glycol terephthalates. Polyester-containing textile materials are blends of polyester and polyamides, in particular polyester-cellulose blend fabrics.

The process according to the invention is carried out with the dyes or dye mixtures in a state of fine division. The dyes are finely divided in a conventional manner by suspending the as-synthesised dye in a liquid medium, preferably water, together with dispersants and subjecting the mixture to the action of shearing forces, which mechanically comminutes the dye particles originally present to such an extent as to produce an optimum specific surface area and keep dye sedimentation to a minimum. The particle sizes of the dyes are in general between 0.5 and 5 μm, preferably about 1 μm.

The dispersants used in the grinding process can be nonionic or anionic. Nonionic dispersants are for example reaction products of alkylene oxides, e.g. ethylene oxide or propylene oxide, with alkylatable compounds, for example fatty alcohols, fatty amines, fatty acids, phenols, alkylphenols and carboxamides. Anionic dispersants are for example ligninsulphonates, alkyl- or alkylarylsulphonates or alkyl-aryl-polyglycol ether sulphonates.

The dye preparations thus obtained should be pourable for most application methods. The dye and dispersant content is therefore limited in these cases. In general, the dispersions are adjusted to a dye content of up to 50% by weight and a dispersant content of up to about 25%. For economic reasons, the dye content is usually not less than 15% by weight.

The dispersions may contain further auxiliaries, for example those which act as oxidising agents, such as sodium m-nitrobenzenesulphonate, or fungicides, e.g. sodium o-phenylphenolate and sodium pentachlorophenolate.

For certain applications it is preferable to have pulverulent formulations. These powders contain the dye or the dye mixture, dispersants and other auxiliaries, for example wetting, oxidising, preserving and dustproofing agents.

A preferred method for preparing pulverulent dye preparations consists in stripping the above-described liquid dye dispersions of the liquid, for example by vacuum drying, freeze drying, drying on drum dryers, but preferably by spray drying.

To prepare dyeing liquors, the necessary amounts of dye formulations prepared as described above are diluted with the dyeing medium, preferably water, to such an extent as to produce for the dyeing a liquor ratio of from 5:1 to 50:1. The liquors are in general additionally admixed with further dyeing auxiliaries, such as dispersing, wetting and fixing auxiliaries.

The necessary dyeing liquor pH is set before or else during the dyeing by addition of bases such as alkali metal hydroxides, e.g. aqueous sodium hydroxide solution, alkali metal bicarbonates, e.g. sodium bicarbonate, or alkali metal carbonates, e.g. sodium carbonate. A preferred pH is pH 9 to 10.

To minimise pH fluctuations, it is preferable to add buffer substances as described for example in JSDC, 77 (1979), p. 47, or JSDC 79 (1981), p. 115. Particularly suitable buffer substances are those which have the greatest buffering effect in the pH range between 9 and 11. Suitable buffer systems are for example acetic acid/sodium pyrophosphate, boric acid/borax, sodium dihydrogenphosphate/disodium hydrogenphosphate, phosphoric acid/succinic acid/boric acid or combinations of organic phosphorus compounds with polycarboxylic acids. The amount of buffer system used is in general between 0.5 and 10 g/l .

The inventive concept will now be more particularly illustrated by reference to examples.

EXAMPLE 1

1.5 g of a 20% strength powder preparation of the dye of the formula II

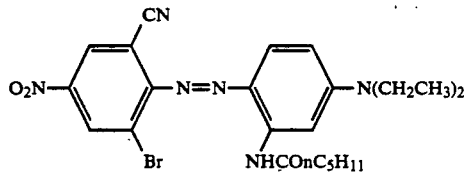

(II)

are applied in a dyeing autoclave in a dyeing liquor consisting of 2 l of water, 2 g of a dyeing auxiliary based on a formaldehyde condensation product and 5 g of a buffer substance comprising a mixture of an organic phosphorus compound and a polycarboxylic acid to 100 g of polyethylene terephthalate fabric at 130° C. in the course of 45 min after the pH of the dyeing liquor has been adjusted to 9.5 with aqueous sodium hydroxide solution. Then the dyeing is rinsed, reduction cleared, rinsed again, and dried. This produces a bluish red dyeing in a bright shade. The dyeing is repeated, except that the buffer substance used is 4 g of sodium acetate and the pH of the dyeing liquor is adjusted to 4.5 with acetic acid. The resulting dyeing is virtually identical in hue and there has been virtually no decomposition of the dye at pH 9.5.

EXAMPLE 2

Replacing the dye of the formula II in Example 1 with 2 g of a 10% strength liquid preparation of the dye of the formula III

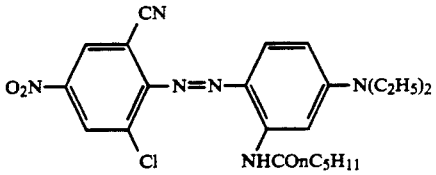

(III)

buffering the dyeing liquor with a mixture of 3.6 ml of phosphoric acid, 4 g of succinic acid and 4 g of boric acid, and adjusting the dyeing liquor pH to 9 likewise results in a bright blue dyeing which is likewise practically identical in colour strength and hue to the corresponding dyeing at pH 4.5.

The table below lists further dyes which can be used in the process according to the invention.

| Hal | R | $R^1$ | $R^2$ |
|---|---|---|---|
| Br | $CH(CH_2CH_3)_2$ | $C_2H_5$ | $C_2H_5$ |
| Cl | $CH(CH_2CH_3)_2$ | $C_2H_5$ | $C_2H_5$ |
| Br | $CH(CH_3)C_3H_7$ | $C_2H_5$ | $C_2H_5$ |
| Cl | $CH(CH_3)C_3H_7$ | $C_2H_5$ | $C_2H_5$ |
| Br | $nC_5H_{11}$ | $C_2H_5$ | $nC_3H_7$ |
| Cl | $nC_5H_{11}$ | $nC_3H_7$ | $nC_3H_7$ |
| Br | $nC_5H_{11}$ | $CH_2CH{=}CH_2$ | $CH_2CH{=}CH_2$ |
| Br | $CH(CH_2CH_3)_2$ | $nC_3H_7$ | $nC_3H_7$ |
| Cl | $nC_4H_9$ | $nC_3H_7$ | $nC_3H_7$ |
| Br | $nC_4H_9$ | $C_2H_5$ | $C_2H_5$ |
| Cl | $nC_4H_9$ | $CH_2CH{=}CH_2$ | $C_2H_5$ |
| Cl | $CH_2CH(CH_3)_2$ | $nC_3H_7$ | $nC_3H_7$ |
| Br | $CH_2CH(CH_3)_2$ | $nC_3H_7$ | $nC_3H_7$ |
| Br | $CH_2CH(CH_3)_2$ | $nC_4H_9$ | $nC_4H_9$ |
| Cl | $CH_2CH(CH_3)_2$ | $C_2H_5$ | $CH_2CH{=}CH_2$ |
| Cl | $CH_2CH(CH_3)_2$ | $C_2H_5$ | $C_2H_5$ |
| Br | $CH(CH_3)C_2H_5$ | $C_2H_5$ | $C_2H_5$ |
| Br | $CH(CH_3)C_2H_5$ | $nC_3H_7$ | $nC_3H_7$ |
| Cl | $CH(CH_3)C_2H_5$ | $nC_3H_7$ | $nC_4H_9$ |
| Cl | $CH(CH_3)C_2H_5$ | $C_2H_5$ | $C_2H_5$ |
| Br | $nC_3H_7$ | $nC_4H_9$ | $nC_4H_9$ |
| Br | $nC_3H_7$ | $nC_3H_7$ | $nC_3H_7$ |
| Cl | $nC_3H_7$ | $nC_3H_7$ | $CH_2CH{=}CH_2$ |
| Cl | $nC_3H_7$ | $nC_5H_{11}$ | $nC_5H_{11}$ |
| Br | $iC_3H_7$ | $nC_4H_9$ | $nC_4H_9$ |
| Cl | $iC_3H_7$ | $nC_4H_9$ | $nC_4H_9$ |
| Cl | $iC_3H_7$ | $nC_3H_7$ | $nC_4H_9$ |
| Br | $iC_3H_7$ | $CH_2CH{=}CH_2$ | $nC_4H_9$ |
| Br | $nC_6H_{13}$ | $C_2H_5$ | $C_2H_5$ |
| Cl | $nC_6H_{13}$ | $C_2H_5$ | $nC_3H_7$ |
| Br | $CH(C_2H_5)C_4H_9$ | $C_2H_5$ | $C_2H_5$ |
| Cl | $CH(C_2H_5)C_4H_9$ | $C_2H_5$ | $C_2H_5$ |
| Br | $(CH_2)_6CH_3$ | $C_2H_5$ | $C_2H_5$ |
| CL | $(CH_2)_6CH_3$ | $C_2H_5$ | $C_2H_5$ |
| Br | $nC_3H_7$ | $nC_5H_{11}$ | $nC_5H_{11}$ |
| Cl | $nC_3H_7$ | $nC_5H_{11}$ | $nC_5H_{11}$ |
| Br | $nC_3H_7$ | $nC_5H_{11}$ | $nC_2H_5$ |
| Br | $iC_3H_7$ | $nC_5H_{11}$ | $nC_3H_7$ |
| Br | $iC_3H_7$ | $nC_5H_{11}$ | $C_2H_5$ |
| Cl | $nC_4H_9$ | $nC_5H_{11}$ | $C_2H_5$ |

The table below lists dye mixtures which may be used in the process according to the invention.

| Hal | R | $R^1$ | $R^2$ | Mixing ratio |
|---|---|---|---|---|
| Br | $nC_5H_{11}$ | $C_2H_5$ | $C_2H_5$ | 50 |
| Cl | $nC_5H_{11}$ | $C_2H_5$ | $C_2H_5$ | 50 |
| Br | $nC_5H_{11}$ | $C_2H_5$ | $C_2H_5$ | 70 |
| Cl | $nC_5H_{11}$ | $C_2H_5$ | $C_2H_5$ | 30 |
| Br | $nC_5H_{11}$ | $C_2H_5$ | $C_2H_5$ | 55 |
| Br | $nC_4H_9$ | $C_2H_5$ | $C_2H_5$ | 45 |
| Cl | $nC_5H_{11}$ | $C_2H_5$ | $C_2H_5$ | 30 |
| Cl | $nC_5H_{11}$ | $nC_3H_7$ | $C_3H_7$ | 20 |
| Br | $nC_5H_{11}$ | $C_2H_5$ | $C_2H_5$ | 60 |
| Br | $nC_4H_9$ | $nC_3H_7$ | $nC_3H_7$ | 40 |
| Cl | $nC_3H_7$ | $C_2H_5$ | $nC_4H_9$ | 10 |
| Cl | $nC_5H_{11}$ | $C_2H_5$ | $nC_3H_7$ | 90 |
| Br | $nC_3H_7$ | $nC_4H_9$ | $nC_4H_9$ | 50 |
| Br | $nC_3H_7$ | $nC_3H_7$ | $nC_3H_7$ | 50 |
| Cl | $nC_5H_{11}$ | $C_2H_5$ | $C_2H_5$ | 30 |
| Cl | $CH(C_2H_5)_2$ | $C_2H_5$ | $C_2H_5$ | 70 |
| Cl | $nC_5H_{11}$ | $C_2H_5$ | $C_2H_5$ | 40 |
| Cl | $CH(CH_3)C_3H_7$ | $C_2H_5$ | $C_2H_5$ | 60 |
| Br | $nC_5H_{11}$ | $C_2H_5$ | $nC_3H_7$ | 90 |
| Cl | $CH(CH_3)C_2H_5$ | $nC_3H_7$ | $nC_3H_7$ | 10 |

We claim:

1. Process for the HT dyeing of polyester or polyester-containing textile materials at pH 8 to pH 11, characterized in that one or more monoazo dyes are used of the general formula I

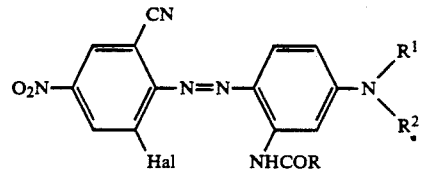

(I)

where

Hal is chlorine or bromine,

R is alkyl of 3 to 7 carbon atoms, and $R^1$ and $R^2$ are each independently of the other linear alkyl of 2 to 5 carbon atoms or allyl.

2. Process according to claim 1, characterized in that one or more dyes are used of the formula I where R is n-butyl, isobutyl, 2-pentyl, 3-pentyl or isopentyl.

3. Process according to claim 1, characterized in that R is n-pentyl.

4. Process according to claim 1 characterized in that $R^1$ and $R^2$ are each independently of the other ethyl, n-propyl, n-butyl or allyl.

5. Process according to claim 1 characterized in that $R^1$ and $R^2$ are identical.

6. Process according to claim 5, characterized in that $R^1$ and $R^2$ are each ethyl.

7. Process according to claim 1 characterized in that the sum total of the carbon atoms in the radicals R, $R^1$ and $R^2$ is 8 to 10.

8. Process according to claim 1 characterized in that the dyeing is carried out at pH 9 to pH 10.

9. Process according to claim 1 characterized in that the dyeing is carried out in the presence of one or more buffer substances which have a buffering effect in the particular pH range used.

* * * * *